United States Patent [19]

Franks, Jr. et al.

[11] Patent Number: 4,553,191

[45] Date of Patent: Nov. 12, 1985

[54] STATIC ELIMINATOR

[75] Inventors: William S. Franks, Jr., Penfield; John M. Randall, Fairport; Joseph A. Swift, Ontario, all of N.Y.

[73] Assignee: Xerox Corporation, Stamford, Conn.

[21] Appl. No.: 446,738

[22] Filed: Dec. 3, 1982

[51] Int. Cl.[4] ..... H05F 3/00

[52] U.S. Cl. ..... 361/212; 361/213; 361/229; 361/230

[58] Field of Search ..... 361/212, 213, 221, 229, 361/230

[56] References Cited

U.S. PATENT DOCUMENTS

| | | | |
|---|---|---|---|
| 2,774,921 | 12/1956 | Walkup | 361/212 |
| 3,235,323 | 2/1966 | Peters | 8/189 |
| 3,691,993 | 9/1972 | Krause et al. | 118/637 |
| 3,757,164 | 9/1973 | Binkowski | 361/221 |
| 3,877,417 | 4/1975 | Jeromin | 118/637 |
| 3,904,929 | 9/1975 | Kanaya et al. | 361/221 X |
| 4,031,188 | 6/1977 | Kohler | 423/447.6 |
| 4,086,650 | 4/1978 | Davis et al. | 361/229 |
| 4,307,432 | 12/1981 | Nishikawa | 361/221 |
| 4,330,349 | 5/1982 | Swift et al. | 156/166 X |
| 4,336,565 | 6/1982 | Murray et al. | 361/225 |
| 4,352,143 | 9/1982 | Uno | 361/221 |
| 4,385,043 | 5/1983 | Cagliostro et al. | 423/447.6 |

OTHER PUBLICATIONS

Description of the Carbonization Process of Polyacrylonitrile Fibers of Electrical Characteristics (L. Brehmer/L. M. Pinnow/J. Ludwig).

Plaste und Kautschuk, vol. 27, No. 6, pp. 309–313, Carbon Fiber Production at Low Temperatures from Polyacryonitrile–D. E. Cagliostro 1980 Textile Research Institute pp. 632–638.

*Primary Examiner*—Harry E. Moose, Jr.

[57] ABSTRACT

A device for neutralizing static electric charge on a surface comprising a support means, a plurality of resilient, flexible thin fibers having an electrical resistivity of from about $2\times10^3$ ohm-cm to about $1\times10^6$ ohm-cm., the fibers being supported by the support means in such manner that the fibers are oriented and extend in a uniform direction, in a brush like configuration from the support means so that the distal ends of the fibers may extend toward a surface which has a static charge which one wishes to neutralize. Preferably, the resilient fibers have a resistivity of from about $4\times10^4$ ohm-cm. to about $4\times10^5$ ohm-cm., and are arranged in a linear array of spaced discrete bundles of fibers in a conductive potting composition in the support holder. Preferably the fibers are made of a partially carbonized polyacrylonitrile fiber and the device may be used in an electrostatographic reproducing machine having at least one dicorotron charging device.

24 Claims, 5 Drawing Figures

STATIC ELIMINATOR

BACKGROUND OF THE INVENTION

The present invention relates generally to devices for neutralizing static electrical charge on a surface. In a particular aspect the present invention is directed to a device for removing or reducing static electrical charge buildup on a piece of paper in an office machine. In a further aspect, the present invention is directed to a machine including at least one electrical component susceptible to being electrically shorted by contact with conductive fibrous material and at least one device for neutralizing static electrical charge on a surface within the machine.

Static neutralizing or discharge devices have been used to remove any static charge or buildup that may occur on copy sheets, or other paper sheets that may be used in the office machine. Since paper is a dielectric material, static electrical charges are generated by contact with various parts of the office machine. This typically happens by frictional contact with the guide members and transport devices, for example. In addition, charge may be created on a paper sheet as a result of operations performed on it. For example, in electrostatographic reproducing machines the copy sheets are subjected to numerous electrostatic charge and discharge operations which can result in creating charge on a paper. The static charge generated at each process step may be either positive or negative and since the paper is thin and flexible it will be repelled from some objects or surfaces and attracted to other objects and surfaces resulting in unpredictable sheet handling. This propensity of the dielectric paper to accept triboelectric charge and hold it presents two problems to the user. The buildup of electrical charges on the sheets can cause the sheets to tend to stick together thereby increasing the difficulty in physically handling the sheets from station to station in an office machine. In addition, with the number of charged sheets being grouped together as in a collector tray, a spark may flow to a human operator, for example, who may come in contact with the sheets. This presents an undesirable shock hazzard to the operator. Furthermore the static electrical charges on the copy sheets attract dust and other machine debris which can end up on the sheet produced from the machine. For example, in an automatic reproducing apparatus using the electrostatographic process, dirt and other machine debris present on the copy sheet prior to the transfer of fusing of the copy of the sheet may result in substantial contamination of the sheet by the dirt and debris. Furthermore with the buildup of charge on copy sheets in an automatic reproducing machine, toner marking material may end up in areas of the sheet where you do not desire it, causing undesirable background and thereby reducing the copy quality. In addition, of course, with successive sheets of paper being electrostatically held together by static electrical charges, the ease with which the copy paper may be handled is dramatically reduced.

It has been previously proposed to eliminate or substantially reduce the propensity for operator shock, to increase paper handling ease, and to also increase copy quality through the use of several devices. Initially these devices took the form of active powered devices which ionize the air around the surface of the copy paper to afford a path to ground through the ionized air. The principal disadvantages of these devices is that they require a separate power supply, produce ozone, and are relatively expensive to include in the machine and to operate. It has also been common practice to employ a "tinsel" type of device at the output end of the machine predominately to dissipate charge in advance of the operator coming into contact or proximity to the copy sheet. These tinsel devices typically take the form of a plurality of metal projections on an electrically grounded support which are positioned transverse to the path of the sheet or web and physically contact the sheet. Performance wise of course, this leaves much to be desired since the electrostatic charge on the copy paper has not been removed until the copy paper has left the automatic machine. In addition, the physical contact may scratch or otherwise deface the sheet. During the processing of the image on the copy paper in an automatic reproducing machine, brute force to insure positive paper handling of the paper is required. Thus, paper handling in such machines requires extensive use of grippers, air puffers and other like devices to physically and very positively handle the copy sheet adding dramatically to the cost and complexity of such machines.

It has also been proposed to use brush type static eliminators in such devices and in particular brushes made of thin stainless steel fibers. These work very well in certain applications and provide sufficient neutralization of the static charge buildup on the copy sheet for many purposes. However, for high image machines producing thousands of copies on paper a noticable fall-off in the performance of the stainless steel eliminator brushes is observed after periods of continued use. In such situations after say 20,000 to 50,000 copies of paper have been processed, the stainless steel type static eliminator while capable of reducing the static charge buildup does not reduce it to a sufficient degree and again, difficulties with regard to the handling of paper occur. In automatic office machines, and in particular electrostatographic copying devices, improved reliablity in terms of physical handling of the copy document has always been sought. The presence of static charge on the paper sheets being handled, and particularly on successive paper sheets, has always been an impediment to achieving high reliability in such a machine.

In an attempt to improve on the static eliminator performance of the stainless steel fibrous brush, it has been suggested to use conductive carbon fibers. It was suggested that the conductive carbon fibers would have better wear life than their stainless steel counterparts, could be used for very long copy cycles such as, for example, the life of the machine. Such carbon fibers typically have steady state DC volume resistivities of the order of $10^{-2}$ to $10^{-3}$ ohm-cm. Static eliminator brushes made of such conductive fibers are capable of functioning to a certain degree, however, they suffer from the deficiencies in that the fibers are thin in diameter and brittle, and therefore the brushes tend to shed. In addition, these fibers typically have elongations less than 2 percent which contribute substantially to the brittle nature of the fiber and therefore brush shedding characteristics. This causes a problem in particular with regard to the charging devices in automatic reproducing machines in that if a shed conductive fiber comes in contact with the charging wire, it has a tendency to arc causing a hot spot on the wire resulting in melting of the wire and breaking of the corotron. Thus the fiber disintegrates,,contaminates the device and disrupts uniformity of the corona charge. This is destructive irreversible damage requiring unscheduled service on the machine. This problem is dramatically encountered when the dicorotron type charging devices described in U.S. Pat. No. 4,086,650, the disclosure of which is totally incorporated herein by reference, are used in a machine having conductive fibers in a static eliminator. U.S. Pat. No. 4,086,650 described a dicorotron type charging device including a discharge electrode such as a conductive wire which has a relatively thick coating of dielectric material such as glass such that substantially no conduction current or DC charging current is permitted therethrough. The discharge device has a conductive shield adjacent the electrode and the imaging surface is charged by means of a displacement current or capacitive coupling through the dielectric material. With the static eliminators using brushes made from conductive carbon fibers, any fibers that shed or break off upon contacting the shield and wire, bridge the shield and wire or the ground and wire. The results in an instantaneous short producing an arc that produces an irreversible damage to the wire. Further the glass on the wire cracks and in a severe case the wire can be severed. The problem is compounded by the fact that the small fibers are difficult to percieve by the unaided eye and the degree of contamination by them cannot be discovered. The difficulty in electrostatographic reproducing machines is also compounded in that the several operations performed on the copy paper as it moves through the machine, provides ample opportunity to distribute the shed fibers throughout the machine increasing the possibility of electrical component failure.

PRIOR ART

Typical of such prior art devices are those described in U.S. Pat. No. 3,757,164, Binkowski, the disclosure of which is hereby totally incorporated by reference in the present application. Binkowski describes a typical static discharge device for reducing static electrical charge on a sheet or web which comprises a fibrous brush. The brush fibers are described as being supple resilient conductive carbonaceous filaments of minute diameter which typically comprise thermochemically converted regenerated cellulose fiber starting material which has been impregnated with a salt composition and subsequently carbonized to produce a conductive fiber material. The fibers contain carbon in proportions ranging from about 70 percent to higher than 99 percent and range in electrical conductivity from semiconductors to good conductors having electrical resistivities of from about $10^{-4}$ ohm-cm to about $10^{10}$ ohm-cm.

SUMMARY OF THE INVENTION

Accordingly it is an object of the present invention to provide an improved static eliminator.

It is another object of the present invention to provide a static eliminator whose fibers upon contact with an electrical component do not electrically short out the electrical component.

It is an additional object of the present invention to provide a static eliminator having good balance between performance as a static eliminator and the possibility of short circuiting an electrical component.

It is a further object of the present invention to provide a static eliminator with a fibrous brush having improved fiber shedding characteristics.

It is a further object of the present invention to provide a relatively inexpensive, easily manufactured static eliminator brush.

It is a further object of the present invention to provide a static eliminator brush with significantly reduced tendency to shed or produce broken fibers and a reduced tendency to cause electrical failure of electrical components.

The above objects and others are accomplished in accordance with the present invention wherein a device for neutralizing static electrical charge on the surface is provided. In particular, the static neutralizing device comprises a support means, a plurality of resilient flexible thin fibers having an electrical resistivity of from about $2\times10^{3}$ ohm-cm to about $1\times10^{6}$ ohm-cm, the fibers being supported by the support means in such manner that the fibers are oriented and extend in a uniform direction in a brush like configuration from the support means so that the distal ends of the fibers may extend toward a surafce which has a static charge which one wishes to neutralize. Preferably, the individual fibers are attached to the support means by a suitable material such as a conductive adhesive or potting composition. In addition, the present invention pertains to an application in a machine including at least one electrical component susceptibile to being electrically shorted by contact with conductive fibrous material and a static electrical charge neutralizing device. Preferably, in the static neutralizing charge device of the present invention, the resilient fibers have a resistivity of from about $4\times10^{4}$ ohm-cm to about $4\times10^{5}$ ohm-cm. In a further embodiment of the present invention, the individual fibers of the static electrical discharge device are generally circular in cross-section and have a diameter of from about 9 to 10 microns. Furthermore, the preferred static electrical discharge of the present invention comprises fibers which under tensile strength will elongate from about 3 percent to 6 percent of their initial length before they fracture. In a preferred embodiment of the present invention, the plurality of fibers are arranged in a linear array of spaced discrete bundles of fibers and comprise a plurality of partially carbonized polyacrylonitrile fibers. During operation of the static discharge device of the present invention a static charge which may, for example, have been built up on a piece of paper in a automatic office machine is capable of being discharged to a static charge of less than 20 nanocoulombs per $8\frac{1}{2}\times11$ inch sheet. In a further preferred embodiment the static electrical discharge device is used in an electrostatographic reproducing machine having at least one dicorotron charging device.

DETAILED DESCRIPTION OF THE INVENTION

It has been found that a very good balance between static charge eliminator performance and electrical component failure may be achieved if the plurality of resiliently flexible thin fibers in a static eliminator have an electrical resistivity of from about $2\times10^3$ ohm-cm to about $1\times10^6$ ohm-cm.

Figure 4:
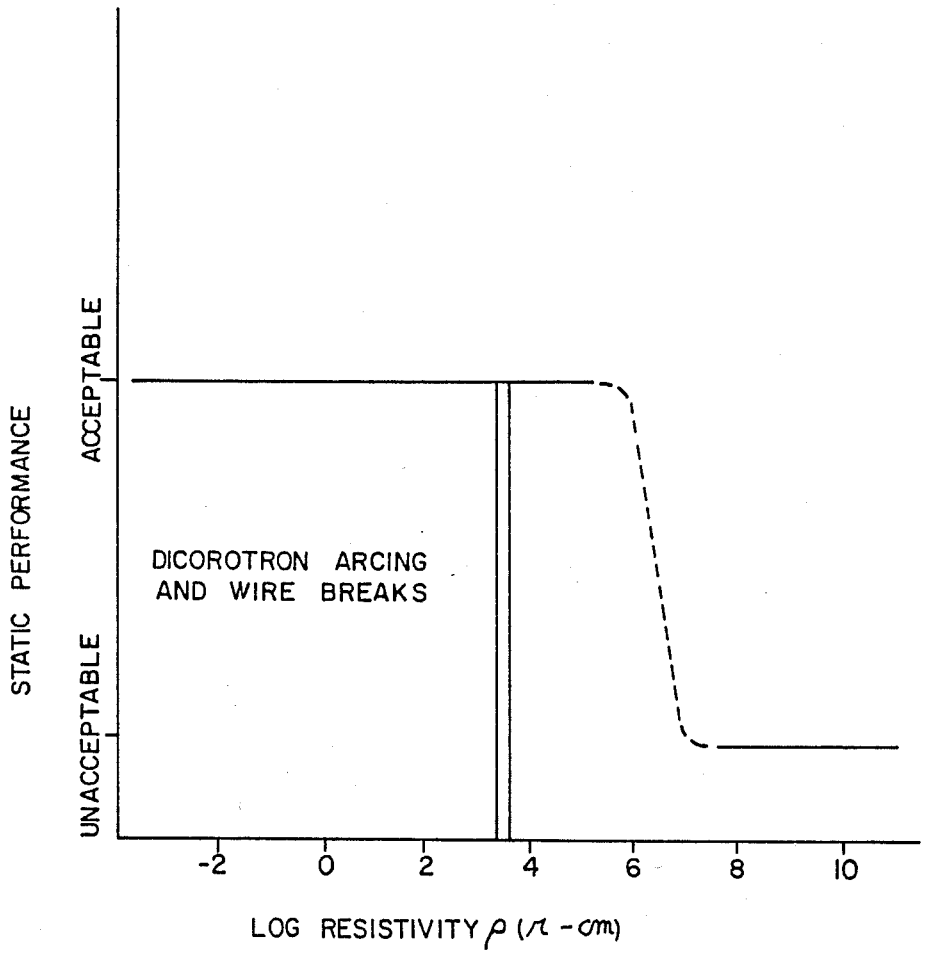
FIG. 4 is a graphical representation of the boundaries of the balance between acceptable static elimination performance, electrical component failure as a result of fiber contamination.

In electrostatographic reproducing machines static charge levels on the copy sheet in the paper transport typically reach levels above 200 nanocoulombs per $8\frac{1}{2}\times11$ inch sheet which unless otherwise altered, creates the conditions previously described, sheets attracted to each other and to machine parts, shock, etc. If however the static charge level is reduced to 20 nanocoulombs per $8\frac{1}{2}\times11$ inch sheet or less, these difficulties are substantially if not completely eliminated. The need for positive brute force devices, such as grippers and puffers is also eliminated and overall copy paper handling reliability is substantially improved. Thus by acceptable static eliminator performance, it is intended to define devices which when they act upon a sheet with a static electrical charge, whatever its level, will reduce that charge to a level less than 20 nanocoulombs per $8\frac{1}{2}\times11$ inch sheet. We have also found that when the electrical resistivity of the static eliminator fiber is between $2\times10^3$ ohm-cm $1\times10^6$ ohm-cm that if or when that fiber sheds and comes into contact with an electrical component, for example, a dicorotron like that described in U.S. Pat. No. 4,086,650, it will not short out or otherwise cause the dicorotron to arc or fail. Reference is directed to FIG. 4 where this is graphically illustrated. As may be seen from FIG. 4, static electrical discharge performance is acceptable for fibers having a resistivity of from about $10^{-3}$ ohm-cm to about $1\times10^6$ ohm-cm, and thereafter falls off rapidly to a totally unacceptable level of about $10^7$ ohm-cm. At the same time, the electrical failure of the dicorotron wire resulting from being contaminated by shed fibers from the static eliminator occurs at high unacceptable levels with resistivity less than about $2\times10^3$ ohm-cm thereby rather precisely defining a balance between acceptable static discharge performance and dicorotron failure. Preferably the resistivity of the brush fibers is from about $4\times10^4$ ohm-cm to about $4\times10^4$ ohm-cm. This range provides the best balance between static eliminator performance and corotron failure as well as providing a wide manufacturability range. Preferably the resistivity of the fibers does not vary significantly with the applied field or in other words, the fibers are ohmic being independent of the field applied over the range of about 1 volt/cm to about 500 volts/cm. The electrical properties of the yarn may also be expressed in terms of the D.C. electrical resistance per unit length and for some applications it may be preferable to do so. In such case the D.C electrical resistance would equate broadly to the range of from about $4\times10^5$ ohm-cm to about $2\times10^8$ ohm-cm and preferably from about $9\times10^6$ ohm-cm to about $9\times10^7$ ohm-cm. With continued reference to FIG. 4, the transition between successful operation and marginal unacceptable performance relies upon many factors. For instance, the input charge on the copy sheet, type of paper, and operation environment all have an effect. Within the broad image defined above and illustrated in the examples we choose the preferred range of from about $4\times10^4$ ohm-cm to about $4\times10^5$ omn-cm to provide the assurance for acceptable operations under all conditions of these variables. There is a sharp discontinuity in performance above about $1\times10^6$ ohm-cm and the acceptable range is thereby defined. This is represented graphically by the broken vertical line in FIG. 4.

The resistive fibers of the present invention are resiliently flexible in that when they are deflected by a sheet passing their location, they spring back into their original position after the trailing edge of the sheet has passed. They are preferably relatively non brittle in order to reduce the propensity of the fibers to shed when they are deflected by a sheet and spread to areas of the machine where they can cause the above-noted problem. Typically the fibers have an elongation under tensile stress of from about 3 percent to about 6 percent of their initial length before they fracture. The higher the elongation the fewer the fibers that will be broken during use. This is in contrast to the relatively brittle conductive carbon fibers which have a typical elongation under tensile stress of about 2 percent or less of their initial length before they fracture. In addition the resistive fibers are generally circular in cross-section and preferably have a diameter of from about 9 microns to about 10 microns, which provides them with a reduced tendency to fracture or break when compared to the thinner conductive fibers described in U.S. Pat. No. 3,757,164. To function effectively within a broad range of environments, it is also preferred that the resistive fibers of the present invention be generally humidity insensitive, that they exhibit a variation of 10 percent of less, preferably less than 2 percent, in resistivity for relative humidity from 0 percent to 100 percent. This is desired to insure that the static eliminators of the present invention adhere to the rather broad boundaries of resistivity illustrated in FIG. 4.

Typically the fibers have a density of about 1.5 grams/cc, a tensile strength of from about 80,000 pounds to about 120,000 pounds per square inch, a modulus of elongation of from about 1,900,000 pounds to about 4,000,000 pounds per square inch.

Figure 2:
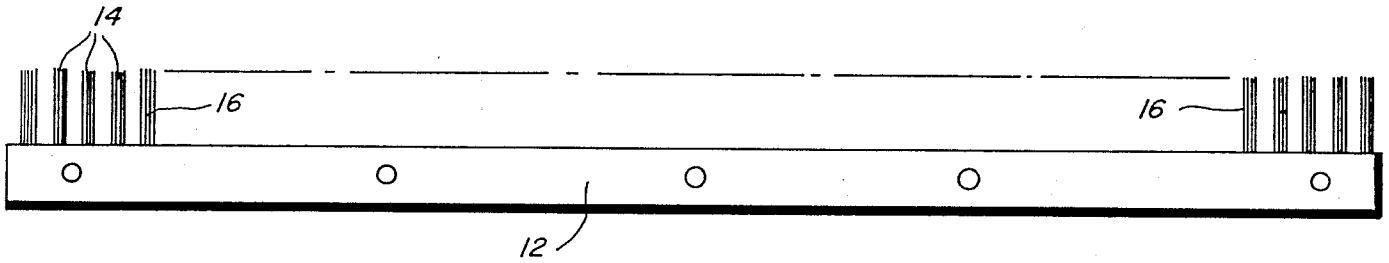
FIGS. 2 and 3 are front views of alternative embodiments of the present invention.
Figure 3:
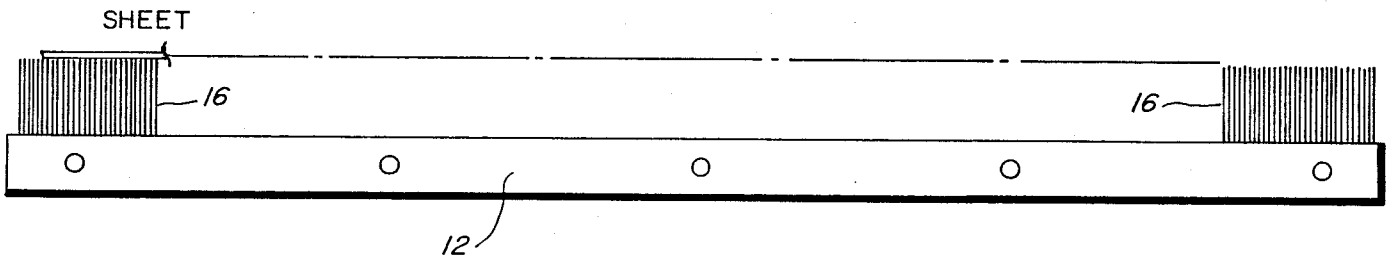

The resistive fibers of the present invention are formed into multifilament continuous yarn bundles having from about 3,000 filaments to about 6,000 filaments per yarn. If the yarn bundle is much higher than about 6,000 filaments it tends to resist deflection by the copy sheet which is undesirable. These yarn bundles may be distributed in a linear array as illustrated in FIG. 3 with each bundle contiguous to the next bundle. Alternatively and preferably, they may be arranged in a liner array of spaced discrete bundles of fibers as illustrated in FIG. 2. This configuration enables suitable discharge of the charged sheet as it passes the static eliminator as well as providing simple space for the other elements in the sheet transport to pass adjacent to the brush.

Figure 1:
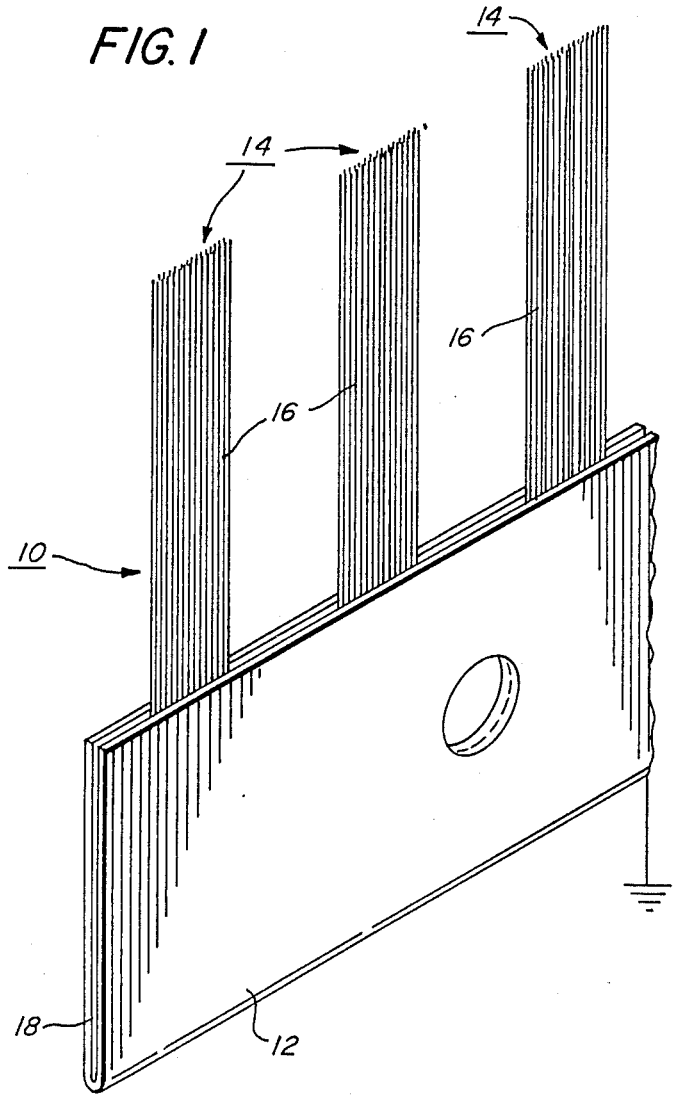
FIG. 1 is an enlarged isometric view of a portion of a static eliminator of the present invention.

Turning now to FIG. 1, the preferred brush configuration is illustrated in further detail. The brush 10 comprises a support or holder 12 which as illustrated here comprises a piece of conductive metal wrapped around a plurality of spaced discrete bundles 14 of individual yarn fibers 16. The individual yarn fiber bundles may be held in place merely by the crimping of the conductive metal around the fibers which is connected to ground potential. Alternatively and preferably, the individual yarn fiber bundles are fixed in the holder with a conductive adhesive or potting composition 18 which alternatively may be connected directly to ground potential. Typical conductive adhesives for this purpose is Electrodag 213 a graphite filled epoxy in a toluene xylene solvent and Electrodag 199 a carbon black in a neprene resin in a toluene solvent both available from Acheson Colloids Company, Port Huron, Mich. In this instance the brush holder or support means need not be conductive but may be electrically insulating. Turning once again to FIGS. 2 and 3, the ends of the fibers may be in contact with the copy sheet on which it is desired to reduce the static charge as illustrated in FIG. 3 or separated from the copy sheet as illustrated in FIG. 2. In operation in the embodiment illustrated in FIG. 2, the ends of the fibers come into direct contact with the copy sheet having a static electrical charge, and the brush fiber ends are deflected by the paper. The brush fiber is connected to a conductive support which in turn is grounded to provide a conductive path to reduce the static electrical charge on the sheet. In the alternative embodiment illustrated in FIG. 3, the brush fiber ends are spaced from the copy sheet bearing a static electrical charge and the device functions as an inductive eliminator for removal of the static electrical charge for the copy sheet as it is moved past the device. In this mode of operation, the charge on the copy sheet creates a field, air breakdown or ionization occurs, and current flows to the brush fibers from the paper.

Any suitable material may be used for the individual fibers in the static eliminator brush of the present invention as long as the fibers exhibit or possess the above described properties. Typically the fibers are carbonaceous or have a carbonaceous core.

A preferred fiber that may be used in the static eliminator of the present invention are those resistive carbon fibers that are obtained from low heat treatment temperature processing to yield partial carbonization of the polyacrylonitrile (PAN) precursor fibers. The polyacrylonitrile precursor fibers are commerically produced by the Celanese Corporation and others in yarn bundles of 3,000 filaments to 6,000 filaments. The yarn bundles are partially carbonized in a two stage process involving stabilizing the PAN fibers at temperatures of the order of 300° C. in an oxygen atmosphere to produce preox stabilized PAN followed by carbonization at elevated temperatures in an inert (helium or nitrogen) atmosphere. The electrical resistivity of the resulting fibers can be controlled by the selection of the temperature of carbonization. For example, carbon fibers having a resistivity of from about $2\times10^3$ ohm-cm to about $1\times10^6$ ohm-cm are obtained if the carbonization temperature is controlled within the range of from about 600° C. to about 750° C.

These carbon fibers are to be distinguished from those described in Binkowski U.S. Pat. No. 3,757,164 in the following respects. The present fibers may be made from commercially available precursor materials which are only partially carbonized to about 65–80 percent carbon by weight which provides a more resistive fiber having a preferred electrical resistance of from about $9\times10^6$ ohm-cm to $9\times10^7$ ohm-cm. In addition, the present fibers have a diameter of 9 to 10 microns thereby providing a comparatively flexible, less brittle fiber which is formed into yarn bundles of from about 3000 to 6000 filaments. This is in contrast to the fibers recited in U.S. Pat. No. 3,757,164 for which there is a limited, if any, supply in the commercial market today. Furthermore the process of U.S. Pat. No. 3,757,164 requires the additional step of salt impregnation of the precursor fiber and the fibers produced are relatively thin, about 6 micron diameter fibers, and are comparatively brittle. In addition, the fibers of U.S. Pat. No. 3,757,164 contain 70–99 percent carbon and are therefore comparatively conductive having a resistance per unit length of 22 ohm-inch. Finally, the filaments in U.S. Pat. No. 3,757,164 have a relatively low filament density about 720 filaments per yarn. This requires considerably more yarn bundles to achieve our desired brush density.

The fibers may be sized with a sizing material to provide structural integrity to the fiber to prevent the yarn bundles from flaring, thereby insuring complete operational integrity. Any suitable sizing material may be used. Typically sizing materials may be selected from well known yarn sizing agents including polyvinyl alcohol, polyvinyl pyrolodene and various epoxy materials. Typically the sizing material is present on the fibers in an amount of from about 0.5 to about 1.3 percent by weight of the total weight of the fiber plus sizing material. Amounts much lower provide inadequate sizing and amounts in excess render the fiber too stiff to be readily deflected by the copy sheet.

The static eliminator device according to the present invention will now be described with reference to the automatic electrostatographic reproducing device schematically illustrated in FIG. 5.

Belt 20 having a photoconductive surface therein moves in the direction of arrow 22 to advance successive portions of the photoconductive surface through the various processing stations disposed about the path of movement thereof.

Initially, a portion of the photoconductive surface passes through charging station where a corona generating device which may be a dicorotron as described previously, indicated generally by the reference numeral 24, charges the photoconductive surface to a relatively high substantially uniform potential.

Next, the charge portion of the photoconductive surface is advanced to an imaging station where it is exposed to an image to be reproduced. This accomplished by a document handling unit, indicated generally by the reference numeral 25 which positions original document 26 facedown on platen 28. The exposure system, indicated generally by reference numeral 27 includes lamp 30 which illuminates document 26 positioned on transparent platen 28. The light rays reflected from document 26 are transmitted through lens 32, which focuses the light image of original document 26 onto the charged portion of the photoconductive surface of belt 20 to selectively dissipate the charge thereof. This records an electrostatic latent image on the photoconductive surface which corresponds to the informational areas contained within the original document. Thereafter, belt 20 advances the electrostatic latent image recorded on the photoconductive surface to the development station. Platen 28 is mounted movably and arranged to move in the direction of arrow 34 to adjust the magnification of the original document being reproduced. Lens 32 moves in synchronism therewith so as to focus the light image of original document 26 onto the charged portion of the photoconductive surface of belt 20.

Document handling unit 25 sequentially feeds documents from a stack of documents placed by the operator in a normal forward collated order in a document stacking and holding tray. The documents are fed from the holding tray, in seriatim, to platen 28. The document handling unit recirculates documents back to the stack supported on the tray. Preferably, the document handling unit is adapted to serially sequentially feed the documents, which may be of various sizes and weights of paper or plastic containing information to be copied.

Figure 5:
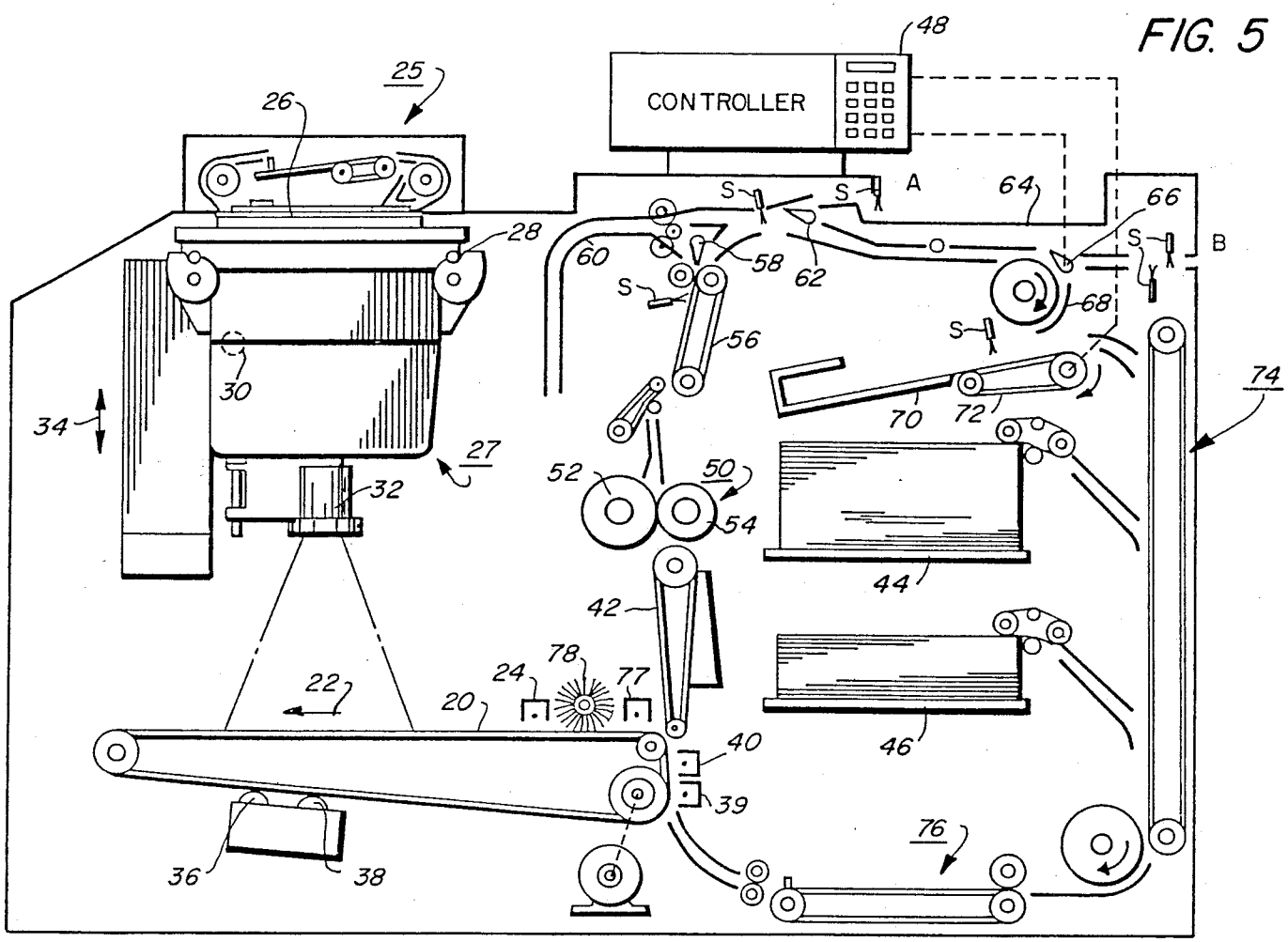
FIG. 5 is a schematic representation of an automatic reproducing machine in which the state eliminators of the present invention may be used.

With continued reference to FIG. 5, at the development station a pair of magnetic brush developer roller, indicated generally by the reference numerals 36 and 38, advance a developer material into contact with the electrostatic latent image. The latent image attracts toner particles from the carrier granules of the developer material to form a toner powder image on the photoconductive surface of belt 20.

After the electrostatic latent image recorded on the photoconductive surface of belt 20 is developed, belt 10 advances the toner powder image to transfer station where a copy sheet is moved into contact with the toner powder image. Transfer station includes a corona generating device 39 which may be a dicorotron as described above which sprays ions onto the backside of the copy sheet. This attracts the toner powder image from the photoconductive surface of belt 20 to the sheet. After transfer conveyor 42 advances the sheet to fusing station 50.

The copy sheets are fed from a selected one of trays 44 or 46 to the transfer station. Each of these trays sense the size of the copy sheet and send an electrical signal indicative thereof to a microprocessor within controller 48. Similarly, the holding tray of document handling unit 15 includes switches thereon which detect the size of the original document and generate an electrical signal indicative thereof which is transmitted also to a microprocessor of controller 48.

The fusing station includes a fuser assembly, indicated generally by the reference numeral 50, which permanently affixes the transferred powder image to the copy sheet. Preferably, a fuser assembly 50 includes a heated fuser roller 52 and backup roller 54. The sheet passes between fuser roller 52 and backup roller 54 with the powder image contacting fuser roller 52. In this manner, the powder image is permanently affixed to the sheet.

After fusing, conveyor 56 transports the sheets to gate 58 which functions as an inverter selector. Depending upon the position of gate 58, the copy sheets will either be deflected into a sheet inverter 60 or bypass sheet inverter 60 and fed directly onto a second decision gate 62. Thus, copy sheets which bypass inverter 60 turn a 90° corner in the sheet path before reaching gate 62. Gate 62 keeps the sheets in a faceup orientation so that the imaged side which has been transferred and fused is faceup. If inverter path 60 is selected, the opposite is true, i.e., the last printed face is facedown. Second decision gate 62 deflects the sheet directly into an output tray 54 or deflects the sheet into a transport path which carries them on without inversion to a third decision gate 66. Gate 66 either passes the sheets directly on without inversion into the output path of the copier, or deflects the sheets into a duplex inverter roll transport 68. Inverting transport 68 inverts and stacks the sheets to be duplexed in a duplex tray 70 when gate 66 so directs. Duplex tray 70 provides intermediate or buffer storage for those sheets which have been printed on one side and on which an image will be subsequently printed on the side opposed thereto, i.e., the copy sheets being duplexed. Due to the sheet inverting by rollers 68, these buffer set sheets are stacked in duplex tray 70 facedown, on top of one another in the order in which they are copied.

In order to complete duplex copying the previously simplexed sheets in tray 70 are fed seriatim by bottom feeder 72 back to the transfer station for transfer of the toner powder image to the opposed side of the sheet. Conveyers 74 and 76 advance the sheet along a path which produces an inversion thereof. However, inasmuch as the bottommost sheet is fed from duplex tray 70, the proper or clean side of the copy sheet is positioned in contact with belt 20 at the transfer station so that the toner powder image thereon is transferred thereto. The duplex sheets are then fed through the same path as the previously simplexed sheets to be stacked in tray 64 for subsequent removal by the printing machine operator.

Returning now to the operation of the printing machine, invariably after the copy sheet is separated from the photoconductive surface of belt 20, some residual particles remain adhering to the belt. These residual particles are removed from the photoconductive surface thereof at the cleaning station which includes a rotatably mounted fibrous brush 78 in contact with the photoconductive surface of belt 20. These particles are cleaned from the photoconductive surface of belt 20 by the rotation of brush 78 in contact therewith. Subsequent to cleaning, a discharge lamp (not shown) floods the photoconductive surface with light to dissipate any residual electrostatic charge remaining thereon prior to the charging thereof for the next successive imaging cycle.

It is believed that the foregoing description is sufficient for purpose of the present application to illustrate the general operation of an electrophotographic printing machine incorporating the features of the present invention therewith.

As may be further observed from FIG. 5, the path that a sheet takes in the automatic reproducing machine is extensive with the sheet coming into contact with several rolls, sheet guides, belts, charge devices, etc., during which charge will buildup on the copy sheet. As previously discussed, if the charge buildup is limited to less than 20 nanocoulombs per $8\frac{1}{2}\times 11$ inch copy sheet, the positive brute force type sheet handling devices such as grippers and puffers are not necessary thereby providing a simplified paper path of improved reliability. To achieve this reduced level of static charge on the copy sheet, static eliminators are positioned at the locations identified by S in the paper path depicted in FIG. 5. In addition, as shown in FIG. 5, there are four corona charging devices which may be dicorotrons as previously described positioned at the following points and performing the following functions. There is the charge corotron 24, transfer corotron 39, detack corotron 40, and preclean corotron 77. As may be seen with continued reference to FIG. 4, it is entirely possible that broken off or shed fibers from the static eliminator brushes in the machine may be transported by the copy sheet or even by small air currents throughout the machine. Some of course will come in contact with the several corona discharge devices. The present invention provides a static eliminator brush, the fibers of which if they come in contact with the corona generating device, will not cause shorting out, arcing, or other electrical failure of the corona generating device. The present invention unexpectedly provides a unique balance between acceptable static eliminator performance on the one hand and, the absence of corona generating device failure on the other hand. This is accomplished with a static eliminator comprising resistive fibers having a resistivity of from about $2\times 10^3$ ohm-cm to about $1\times 10^6$ ohm-cm.

The invention will now be further described with reference to the following specific examples. With a Xerox 1075 automatic reproducing apparatus which is illustrated schematically in FIG. 4 and equipped with four dicorotron charging as previously described six static eliminator brushes of the configuration illustrated in FIGS. 1 and 2 were tried in the machine as follows with the following results. Unless otherwise specified the operation of the machine and the materials were the same except for the static eliminator brushes.

EXAMPLE I

The static eliminator brushes were made of partially carbonized PAN fibers having an electrical resistivity of $5.0\times10^3$ ohm-cm. The machine was operated for more than 10,000 copies without failure of a single dicorotron. The charge of the copy sheet was measured at the following machine output locations A and B (FIG. 5) and found to be between 5 and 8 nanocoulombs and always below 20 nanocouloums per $8\frac{1}{2}\times11$ inch sheet.

EXAMPLE II

The static eliminator brushes were made of partially carbonized PAN fibers having an electrical resistivity of $5.0\times10^4$ ohm-cm. The machine was operated for more than 20,000 copies without failure of a single dicorotron. The charge of the copy sheet was measured at the same locations as in Example I and found to be typically 5 to 8 nanocoulombs and always below 20 nanocoulombs per $8\frac{1}{2}\times11$ inch sheet.

EXAMPLE III

The static eliminator brushes were made of partially carbonized PAN fibers having an electrical resistivity of $3.0\times10^5$ ohm-cm. The machine was operated for more than 100,000 copies without failure of a single dicorotron. The charge of the copy sheet was measured at the same locations as in Example I and found to be typically 5 to 10 nanocoulombs and always below 20 nanocoulombs per $8\frac{1}{2}\times11$ inch sheet.

EXAMPLE IV

The static eliminator brushes were made of conductive carbon fibers from Courtaulds Ltd., London, England, described as type XAS PAN fibers having an electrical resistivity of about $10^{-2}$ ohm-cm. After providing generally less than 1000 copies in each of 5 test machines (Xerox 1075) at least one dicorotron failed by being shorted out as a result of shed static eliminator fibers contacting the glass coated wire. By 10,000 copies, each test machine averaged four such failures.

EXAMPLE V

The static eliminator brushes were made of partially carbonized PAN fibers having an electrical resistivity of $3\times10^6$ ohm-cm. The machine was operated for 31,000 copies without failure of a single dicorotron. The charge of the copy sheet was measured at the same locations as in Example I and found to be typically 40 to 50 nanocoulombs per $8\frac{1}{2}\times11$ inch sheet.

EXAMPLE VI

The static eliminator brushes were made of partially carbonized PAN fibers having an electrical resistivity of $2.2\times10^7$ ohm-cm. The machine was operated for 5,000 copies with no dicorotron failure. However the charge on a copy sheet was 80 to 100 nanaocoulombs per $8\frac{1}{2}\times11$ sheet leading to stacking problems and operator detactable shades.

EXAMPLE VII

The static eliminator rushes were made of 12 micron diameter stainless steel fibers having a resistivity of about $1\times10^{-5}$ ohm-cm. Several machines were tested with these fibers and after about 10,000 copies the machines averaged four (4) dicorotron failures by being shorted out.

The following examples represent testing of fibers in a laboratory fixture where a dicorotron was energized to 7,000 volts A.C. to operate in a stress mode which is slightly higher than the 6,000 volts used in the Xerox 1075. Partially carbonized PAN fibers having the stated electrical resistivity were placed in small dustings onto the dicorotron. Dicorotron success or failure is as indicated.

| EXAMPLE | FIBER RESISTIVITY | DICOROTRON SUCCESS |
|---|---|---|
| EXAMPLE VIII | $3.2\times10^{-1}$ ohm-cm | Shorted |
| EXAMPLE IX | $1.1\times10^{2}$ ohm-cm | Shorted |
| EXAMPLE X | $2.3\times10^{3}$ ohm-cm | Did not Short |
| EXAMPLE XI | $2.0\times10^{4}$ ohm-cm | Did not Short |
| EXAMPLE XII | $4.4\times10^{5}$ ohm-cm | Did not Short |

In the above Examples, Examples IV–IX are not according to the invention but are presented for comparative purposes to illustrate the surprisingly unexpected and superior results obtained with the resistive fibers of the present invention. It is believed that these Examples clearly show the significant improvement over existing static eliminator devices in eliminating an electrical component failure. It is also believed that they demonstrate the surprising balance achieved between electrical component failure and static eliminator performance. The resistive fibers of the present invention upon shedding have a significant reduced tendency to cause shorting out or other electrical component failure. Furthermore, with the fibers being slightly larger in diameter than conductive carbon fibers, they are easier to handle and process and produce fewer broken fibers. The static eliminators of the present invention have the advantage of being relatively inexpensive to manufacture, do not require a separate power supply, produce little or no ozone and still provide a suitable balance between performance and electrical component failure.

While the invention has been described in detail with specific reference to office machines and in particular, electrostatographic reproducing machines, specifically a Xerox 1075 with dicorotron charging devices it will be appreciated that the static eliminators of the present invention have application in many different fields. They may be used in any environment where it is desired to reduce the level of static charge in the presence of electrical equipment such as power supplies, transformers, motors, circuit boxes, etc. Furthermore, while the invention has been exemplified with specific reference to partially carbonized polyacrylonitrile fibers, it should be understood that it has application with any fibers having the specified electrical properties. It will also be appreciated that various modifications may be made from the specific details without departing from the spirit and scope of the invention. It is intended that any such modification as may be made by the artisan shall come within the scope of the appended claims.

We claim:

1. A device for neutralizing static electrical charge on a surface comprising a support means, a plurality of resiliently flexible thin ohmic partially carbonized polyacrylonitrile fibers having an electrical resistivity of from about $2\times10^3$ ohm-cm to about $1\times10^6$ ohm-cm, said fibers being supported by said support means in such manner that said fibers are oriented and extend in a uniform direction in a brush like configuration from the support means so that the distal ends of the fibers may extend toward a said surface to afford reduction of any static electrical charge on said surface, and means for attaching said fibers to said support means.

2. A device according to claim 1 wherein said resistivity is from about $4\times10^4$ ohm-cm to about $4\times10^5$ ohm-cm.

3. A device according to claim 1 wherein said fibers are generally circular in cross-section and have a diameter of from about 9 to about 10 microns.

4. A device according to claim 1 wherein said fibers may be elongated under tensile stress from about 3 percent to about 6 percent of their initial length before they fracture.

5. A device according to claim 1 wherein said means for attaching said fibers to said support means comprises a conductive adhesive or potting compound.

6. A device according to claim 1 wherein said device is capable of reducing static charge on said surface to less than 20 nanocoulombs per $8\frac{1}{2}\times11$ inch sheet.

7. A device according to claim 1 wherein said plurality of fibers is arranged in a linear array with the fibers being positioned contiguously on said support means.

8. The device according to claim 1 wherein said plurality of fibers is arranged in a linear array of spaced discrete bundles of fibers.

9. The device according to claim 1 wherein said plurality of fibers are from about 65–85 percent by weight carbon.

10. The device according to claim 1 wherein said fibers are present in a yarn bundle, each said bundle having from about 3,000 to about 6,000 fibers per bundle.

11. A machine including at least one electrical component susceptible to being electrically shorted by contact with conductive fibrous material, and in proximity to said at least one electrical component at least one device for neutralizing static electrical charge on a surface, said neutralizing device comprising a support means, a plurality of resiliently flexible thin ohmic partially carbonized polyacrylonitrile fibers having an electrical resistivity of from about $2\times10^3$ ohm-cm to about $1\times10^6$ ohm-cm, said fibers being supported by said support means in such manner that said fibers are oriented and extend in a uniform direction in a brush like configuration from the support means so that the distal ends of the fibers may extend toward a said surface to afford reduction of any static electrical charge on said surface, and means for attaching said fibers to said support means.

12. A machine according to claim 11 further including means for defining a path for sheet material and wherein said surface comprises sheet material, said neutralizing device being positioned transversely to and extending across said path.

13. A machine according to claim 11 wherein said at least one electrical component is a dicorotron comprising a glass coated conductive wire electrode.

14. A machine according to claim 11 wherein said machine is an electrostatographic reproducing machine.

15. A machine according to claim 11 wherein said plurality of fibers are electrically connected to ground potential.

16. A machine according to claim 15 wherein said resistivity is from about $4\times10^4$ ohm-cm to about $4\times10^5$ ohm-cm.

17. A device according to claim 15 wherein said fibers are generally circular in cross-section and have a diameter of from about 9 to about 10 microns.

18. A device according to claim 15 wherein said fibers may be elongated under tensile stress from about 3 percent to about 6 percent of their initial length before they fracture.

19. A device according to claim 15 wherein said means for attaching said fibers to said support means comprises a conductive adhesive or potting compound.

20. A device according to claim 15 wherein said device is capable of reducing static charge on said surface to less than 20 nanocoulombs per $8\frac{1}{2}\times11$ inch sheet.

21. A device according to claim 15 wherein said plurality of fibers is arranged in a linear array with the fibers being positioned contiguously on said support means.

22. The device according to claim 15 wherein said plurality of fibers is arranged in a linear array of spaced discrete bundles of fibers.

23. The device according to claim 15 wherein said plurality of fibers are from about 65 to 80 percent by weight carbon.

24. The device according to claim 15 wherein said fibers are present in a yarn bundle, each said bundle having from about 3,000 to about 6,000 filaments per bundle.

* * * * *